US008290742B2

(12) United States Patent
Burton et al.

(10) Patent No.: US 8,290,742 B2
(45) Date of Patent: Oct. 16, 2012

(54) METHODS AND SYSTEMS FOR DETERMINING DEHUMIDIFIER PERFORMANCE

(75) Inventors: Brandon L. Burton, Sedro-Woolley, WA (US); Robert Pendergrass, Sedro-Woolley, WA (US)

(73) Assignee: Dri-Eaz Products, Inc., Burlington, WA (US)

( * ) Notice: Subject to any disclaimer, the term of this patent is extended or adjusted under 35 U.S.C. 154(b) by 349 days.

(21) Appl. No.: 12/272,455

(22) Filed: Nov. 17, 2008

(65) Prior Publication Data

US 2010/0125367 A1 May 20, 2010

(51) Int. Cl.
*G21C 17/00* (2006.01)

(52) U.S. Cl. ..... 702/182

(58) Field of Classification Search ..... 702/182, 702/183, 186

See application file for complete search history.

(56) References Cited

U.S. PATENT DOCUMENTS

| | | | |
|---|---|---|---|
| 1,690,108 | A | 11/1928 | Grady |
| 1,870,457 | A | 8/1932 | Kenney |
| 1,894,026 | A | 1/1933 | Derry |
| 2,093,725 | A | 9/1937 | Hull |
| 2,130,092 | A | 9/1938 | Kettering |
| 2,168,975 | A | 2/1940 | Herz |
| 2,623,364 | A | 12/1952 | Munters |
| D171,429 | S | 2/1954 | Thompson |
| 2,719,596 | A | 10/1955 | Kent et al. |
| 2,758,390 | A | 8/1956 | Munters |
| 2,686,956 | A | 5/1959 | Loveley |
| 2,905,851 | A | 9/1959 | Caussin |
| 2,932,178 | A | 4/1960 | Armstrong et al. |
| 2,959,036 | A | 11/1960 | Mehalick |
| 2,975,609 | A | 3/1961 | Allander et al. |
| 3,000,193 | A | 9/1961 | Crider |
| 3,035,419 | A | 5/1962 | Wigert |
| 3,097,507 | A | 7/1963 | Makuh |
| 3,141,762 | A | 7/1964 | Serck-Hanssen |
| 3,149,479 | A | 9/1964 | Peterson |
| D212,777 | S | 11/1968 | Anderson |
| 3,621,906 | A | 11/1971 | Leffert |
| 3,623,549 | A | 11/1971 | Smith, Jr. |
| 3,807,493 | A | 4/1974 | Stewart |
| 3,820,581 | A | 6/1974 | Machida et al. |

(Continued)

FOREIGN PATENT DOCUMENTS

CN 1046384 A 7/1990

(Continued)

OTHER PUBLICATIONS

"Air Conditioner/Dehumidifier," abstract from Spinoff 1986 article, facsimile dated Nov. 29, 1999, 2 pages.

(Continued)

*Primary Examiner* — Mohamed Charioui
(74) *Attorney, Agent, or Firm* — Perkins Coie LLP

(57) ABSTRACT

Methods, systems, and apparatuses directed to determining the performance of a dehumidifier are disclosed herein. A method of determining dehumidifier performance configured in accordance with one embodiment includes determining an inlet humidity value for airflow entering the dehumidifier, and determining an outlet humidity value for airflow exiting the dehumidifier. The outlet humidity value is determined based at least in part on an efficiency or correction factor for the dehumidifier. The method further includes comparing the inlet humidity value with the outlet humidity value to determine the amount of moisture that the dehumidifier is removing for the air.

27 Claims, 5 Drawing Sheets

U.S. PATENT DOCUMENTS

| | | | | |
|---|---|---|---|---|
| 3,877,518 | A | | 4/1975 | Dreksler |
| 3,968,833 | A | | 7/1976 | Strindehag et al. |
| 4,000,779 | A | | 1/1977 | Irwin |
| 4,044,820 | A | | 8/1977 | Nobles |
| 4,091,547 | A | | 5/1978 | Leigh |
| 4,176,525 | A | | 12/1979 | Tucker et al. |
| 4,183,399 | A | | 1/1980 | Seehausen |
| 4,189,848 | A | | 2/1980 | Ko et al. |
| D254,566 | S | | 3/1980 | Cummins |
| 4,259,268 | A | | 3/1981 | DiRoss |
| 4,280,483 | A | | 7/1981 | Schaffer |
| 4,295,342 | A | | 10/1981 | Parro |
| 4,333,517 | A | | 6/1982 | Parro |
| 4,428,207 | A | | 1/1984 | Hall |
| 4,452,051 | A | | 6/1984 | Berger et al. |
| 4,502,286 | A | | 3/1985 | Okada et al. |
| 4,546,820 | A | | 10/1985 | Whipple |
| 4,607,498 | A | | 8/1986 | Dinh |
| 4,615,383 | A | | 10/1986 | Hisao |
| 4,628,696 | A | | 12/1986 | Rodgers |
| 4,724,901 | A | | 2/1988 | Munekawa |
| 4,771,824 | A | | 9/1988 | Rojey et al. |
| 4,827,733 | A | | 5/1989 | Dinh |
| 4,921,041 | A | | 5/1990 | Akachi |
| D308,414 | S | | 6/1990 | Makihara |
| 4,938,035 | A | | 7/1990 | Dinh |
| 4,942,740 | A | | 7/1990 | Shaw et al. |
| D310,412 | S | | 9/1990 | Fukumoto et al. |
| 4,971,139 | A | | 11/1990 | Khattar |
| 5,031,411 | A | * | 7/1991 | Gehring et al. ..... 62/93 |
| 5,033,539 | A | | 7/1991 | Kohtaka |
| 5,050,109 | A | * | 9/1991 | Ladd ..... 73/76 |
| D325,252 | S | | 4/1992 | Morris et al. |
| 5,115,645 | A | | 5/1992 | Abraham |
| 5,117,651 | A | | 6/1992 | Suh |
| 5,219,020 | A | | 6/1993 | Akachi |
| D337,592 | S | | 7/1993 | Hider et al. |
| 5,265,895 | A | | 11/1993 | Barrett |
| 5,269,151 | A | | 12/1993 | Dinh |
| D343,706 | S | | 1/1994 | Gurstein |
| 5,333,470 | A | | 8/1994 | Dinh |
| 5,394,040 | A | | 2/1995 | Khanh |
| 5,404,938 | A | | 4/1995 | Dinh |
| D361,178 | S | | 8/1995 | Piret |
| 5,443,624 | A | | 8/1995 | Claesson |
| 5,448,897 | A | | 9/1995 | Dinh |
| D364,947 | S | | 12/1995 | Kent et al. |
| D368,770 | S | | 4/1996 | Tanner et al. |
| 5,548,905 | A | | 8/1996 | Kuma et al. |
| 5,564,184 | A | | 10/1996 | Dinh |
| 5,582,246 | A | | 12/1996 | Dinh |
| D379,016 | S | | 4/1997 | Wilson |
| 5,634,353 | A | | 6/1997 | Hallin et al. |
| 5,649,372 | A | * | 7/1997 | Souza ..... 34/491 |
| 5,684,672 | A | * | 11/1997 | Karidis et al. ..... 361/679.26 |
| 5,736,647 | A | * | 4/1998 | Matsubara et al. ..... 73/861.22 |
| D394,499 | S | | 5/1998 | Bettag et al. |
| 5,746,061 | A | * | 5/1998 | Kramer ..... 62/127 |
| 5,749,415 | A | | 5/1998 | Dinh |
| D395,492 | S | | 6/1998 | Phillips et al. |
| 5,794,453 | A | | 8/1998 | Barnwell |
| D402,021 | S | | 12/1998 | Allen et al. |
| 5,845,702 | A | | 12/1998 | Dinh |
| 5,890,368 | A | | 4/1999 | Lakdawala |
| 5,901,565 | A | | 5/1999 | Morton, Jr. |
| 5,921,315 | A | | 7/1999 | Dinh |
| 5,953,831 | A | | 9/1999 | Yu |
| 5,953,926 | A | | 9/1999 | Dressler et al. |
| 5,992,161 | A | | 11/1999 | O'Halloran et al. |
| D419,230 | S | | 1/2000 | Ciccone |
| D420,473 | S | | 2/2000 | Shero |
| 6,021,644 | A | | 2/2000 | Ares et al. |
| 6,030,426 | A | | 2/2000 | Stopyra et al. |
| 6,035,551 | A | | 3/2000 | Scheufler et al. |
| D422,351 | S | | 4/2000 | Griffin |
| D422,386 | S | | 4/2000 | Jaros et al. |
| D426,473 | S | | 6/2000 | Blackburn |
| 6,101,815 | A | * | 8/2000 | van Oort et al. ..... 62/3.4 |
| 6,105,278 | A | * | 8/2000 | Gerrish et al. ..... 34/497 |
| D441,161 | S | | 4/2001 | Shetterly |
| 6,223,543 | B1 | | 5/2001 | Sandelman |
| 6,237,352 | B1 | | 5/2001 | Goodchild |
| D445,116 | S | | 7/2001 | Evans et al. |
| D453,560 | S | | 2/2002 | Van Brunt |
| 6,447,586 | B1 | | 9/2002 | Campbell |
| D465,018 | S | | 10/2002 | Gustafsson et al. |
| 6,463,794 | B1 | * | 10/2002 | Moshe et al. ..... 73/73 |
| D480,467 | S | | 10/2003 | White |
| 6,644,060 | B1 | | 11/2003 | Dagan |
| 6,796,896 | B2 | | 9/2004 | Laiti |
| D500,848 | S | | 1/2005 | Holderfield et al. |
| 6,895,774 | B1 | | 5/2005 | Ares et al. |
| D508,735 | S | | 8/2005 | Klein |
| 6,941,763 | B2 | | 9/2005 | Maeda et al. |
| D515,190 | S | | 2/2006 | Bartholmey et al. |
| 7,194,870 | B1 | | 3/2007 | O'Brien et al. |
| 7,246,503 | B1 | | 7/2007 | O'Brien et al. |
| 7,281,389 | B1 | | 10/2007 | O'Brien et al. |
| D565,269 | S | | 3/2008 | Tomasiak et al. |
| D572,356 | S | | 7/2008 | Harber |
| D612,032 | S | | 3/2010 | Gildersleeve et al. |
| 2003/0034573 | A1 | * | 2/2003 | Mulvaney ..... 261/26 |
| 2005/0011255 | A1 | | 1/2005 | Weisenberger et al. |
| 2005/0011962 | A1 | | 1/2005 | Weisenberger et al. |
| 2005/0066538 | A1 | | 3/2005 | Goldberg et al. |
| 2005/0183430 | A1 | | 8/2005 | McMillan et al. |
| 2006/0214315 | A1 | | 9/2006 | Williams |
| 2007/0012060 | A1 | | 1/2007 | Simons |
| 2007/0107450 | A1 | | 5/2007 | Sasao et al. |
| 2008/0028776 | A1 | | 2/2008 | O'Brien et al. |
| 2008/0223050 | A1 | | 9/2008 | Bruders et al. |
| 2009/0101727 | A1 | | 4/2009 | Boudreau |
| 2011/0061408 | A1 | | 3/2011 | Schnelle |

FOREIGN PATENT DOCUMENTS

| | | | |
|---|---|---|---|
| EP | 0046528 | A1 | 3/1982 |
| EP | 830554 | A1 | 3/1998 |
| EP | 893657 | A1 | 1/1999 |
| FR | 2687464 | A1 | 8/1993 |
| GB | 1311232 | A | 3/1973 |
| GB | 2006950 | A | 5/1979 |
| JP | 60188795 | A | 9/1985 |
| JP | 61164622 | A | 7/1986 |
| JP | 62023418 | A | 1/1987 |
| JP | 01041792 | A | 2/1989 |
| JP | 6111591 | A | 4/1994 |
| JP | 08135999 | A | 5/1996 |
| JP | 09239230 | A | 9/1997 |
| WO | WO-9112476 | A1 | 8/1991 |
| WO | WO-9641111 | A1 | 12/1996 |
| WO | WO-02-50623 | A1 | 6/2002 |
| WO | WO-2008057647 | A2 | 5/2008 |

OTHER PUBLICATIONS

"DrizAir 2400 Dehumidifier: Introduced in Aug. of 1998 . . . ", from web site, <http://www.dri-eaz.com/2400.htm>, Jan. 10, 2000, 2 pages.

Dri-Eaz, "Driz-Air 2400 Captures Design Award," <http://www.dri-eaz.com/newsreleases/newsrelease999.html>, internet accessed on Jan. 10, 2000, 2 pages.

Dri-Eaz, Product Catalog, Jan. 1, 2003, Burlington, Washington, U.S., 3 pages.

Dri-Eaz, "2002 Product Catalog," Jan. 1, 2002, 7 pages.

Dri-Eaz, "DrizAir 120 Dehumidifier-Model Comparisons," undated, 4 pages.

Dri-Eaz, "DrizAir 2400 Dehumidifier," undated, 4 pages.

Heat Pipe Technology, Inc., "Dinh Dehumidifier Heat Pipes, Commercial and Industrial Applications," undated, 8 pages.

Hodnell, Charles, "Wrap-Around Heat Pipe Makes Its Debut!" Hot Line Newsletter, vol. 15, No. 1, Mar. 1995, 2 pages.

Johannesen, R., et al., "Efficient Humidity Control with Heat Pipes," University of Florida—Florida Cooperative Extension Service, Fact Sheet, Dec. 1991, 7 pages.

Jon-Don; Gale Force Air Mover from Dry-Air at Jon-Don; www.jondon.com/galeforce/; Mar. 2003, 3 pages.

News Release, "Dri-EAZ Products Introduces Rotomolded Dehumidifier", Aug. 27, 1998, from web site, <http://www.dri-eaz/newsreleases898.html>, 3 pages.
Tropic Kool, "What are Heat Pipes?" <http://tropickool.com/heat-pipes.html>, internet accessed on Nov. 29, 1999, 6 pages.
U.S. Appl. No. 12/767,526, filed Apr. 26, 2010, Pendergass.
U.S. Appl. No. 29/360,550, filed Apr. 27, 2010, Wolfe et al.
International Search Report and Written Opinion, International Application No. PCT/US09/64737, Mail Date Dec. 30, 2009, 15 pages.
Drieaz, "Complete Drying Solutions for Restorative Drying Professionals," 2000, 3 pages.
Dri-Eaz, "DrizAir 1200 Dehumidifier," 2000, 3 pages.
Dri-Eaz, Owner's Manuel—Evolution™ LGR Dehumidfier, 115v Model, Dri Eaz Products, Inc., www.dri-eaz.com, 2007, 7 pages.
Phoenix Restoration Equipment, "Phoenix 200 HT—High Temperature Performance," www.us.phoenix.com undated, 2 pages.

* cited by examiner

METHODS AND SYSTEMS FOR DETERMINING DEHUMIDIFIER PERFORMANCE

TECHNICAL FIELD

The following disclosure relates generally to dehumidifiers and, more particularly, to methods and systems for determining dehumidifier performance.

BACKGROUND

Dehumidifiers are used in many different applications for removing moisture from air. For example, dehumidifiers are used in residential applications to reduce the level of humidity in the air for health reasons. Dehumidifiers are also frequently used in commercial or industrial applications to remove moisture from the air in restoration projects necessitated by flooding or other types of water damage.

A conventional dehumidifier typically includes a refrigeration cycle in which a compressor delivers a hot compressed gas refrigerant to a condenser. The condenser condenses the hot gas refrigerant to a hot liquid refrigerant and delivers the hot liquid refrigerant to an expansion device. The expansion device expands the hot liquid refrigerant to reduce the temperature and pressure of the liquid. The expansion device delivers the cooled liquid refrigerant to an evaporator, and the evaporator evaporates the cooled gas refrigerant. The evaporator returns the cooled gas refrigerant to the compressor to complete the refrigeration cycle. A conventional dehumidifier typically directs airflow over some of these components of the refrigeration cycle to remove the moisture from the air. More specifically, a conventional dehumidifier typically includes an air mover that directs the airflow across the evaporator to cool the airflow below the dew point temperature of the air so that water vapor in the air is condensed to liquid and removed from the air. The air mover can also direct the dehumidified airflow across the condenser to warm the air before the airflow exits the dehumidifier.

One problem associated with conventional dehumidifiers, however, is that it can be difficult to accurately determine the amount of moisture that a dehumidifier removes from the air, which is also known as the dehumidifier performance. More specifically, determining the performance of a dehumidifier can be extremely inaccurate due to the elevated temperature of the airflow exiting the dehumidifier. In certain applications, an erroneous indication of the performance of a dehumidifier can have a significant financial impact. In water restoration projects, for example, property insurers may withhold payment for the use of a dehumidifier if the performance of the dehumidifier does not meet a predetermined level.

SUMMARY

The following summary is provided for the benefit of the reader only, and is not intended to limit the disclosure as set forth by the claims in any way. Aspects of the present disclosure are directed generally toward methods, systems, and apparatuses for determining the performance of a dehumidifier. The methods, systems, and apparatuses described herein are directed to determining dehumidifier performance based at least in part on a mass flow balance and/or an energy balance with reference to the dehumidifier of interest, thereby avoiding the measurement of certain properties (e.g., outlet relative humidity) that introduce error into conventional dehumidifier performance calculations. For example, a method for determining dehumidifier performance in accordance with one embodiment of the disclosure includes measuring an inlet temperature and an inlet relative humidity of airflow entering a dehumidifier. The method also includes determining an inlet humidity value (e.g., an inlet humidity ratio) of airflow entering the dehumidifier based on the inlet temperature and the inlet relative humidity. The method further includes measuring an outlet temperature of airflow exiting the dehumidifier, and determining an outlet humidity value (e.g., an outlet humidity ratio) of airflow exiting the dehumidifier that is based at least in part on the outlet temperature and an efficiency or performance factor of the dehumidifier. In certain embodiments, the efficiency or performance factor is based at least in part on a moisture removal rate and energy consumed (e.g., the current drawn) by the dehumidifier. The outlet humidity value can be determined based on an energy balance of the dehumidifier that takes into account the efficiency of performance factor of the dehumidifier. In other embodiments, the outlet humidity value can be determined based on a mass flow balance of the dehumidifier that takes into account the efficiency or performance factor of the dehumidifier. After determining the outlet humidity value, the method further include comparing the inlet humidity value and the outlet humidity value to determine the amount of moisture removed by the dehumidifier from airflow passing through the dehumidifier. As described in greater detail below, based on the energy and mass flow balances, the methods, apparatuses, and systems described herein can determine the dehumidifier performance without requiring the measurement of an outlet relative humidity of airflow exiting the dehumidifier.

DETAILED DESCRIPTION

Several embodiments are described below with reference to a dehumidifier that is configured to remove moisture from an airflow passing through the dehumidifier. Certain details are set forth in the following description and in FIGS. 1-5 to provide a thorough understanding of various embodiments of the disclosure. Other details describing well-known structures and components often associated with dehumidifiers, however, are not set forth below to avoid unnecessarily obscuring the description of the various embodiments of the disclosure. In addition, further embodiments of the disclosure may be practiced without several of the details described below, while still other embodiments of the disclosure may be practiced with additional details and/or features.

Figure 1:
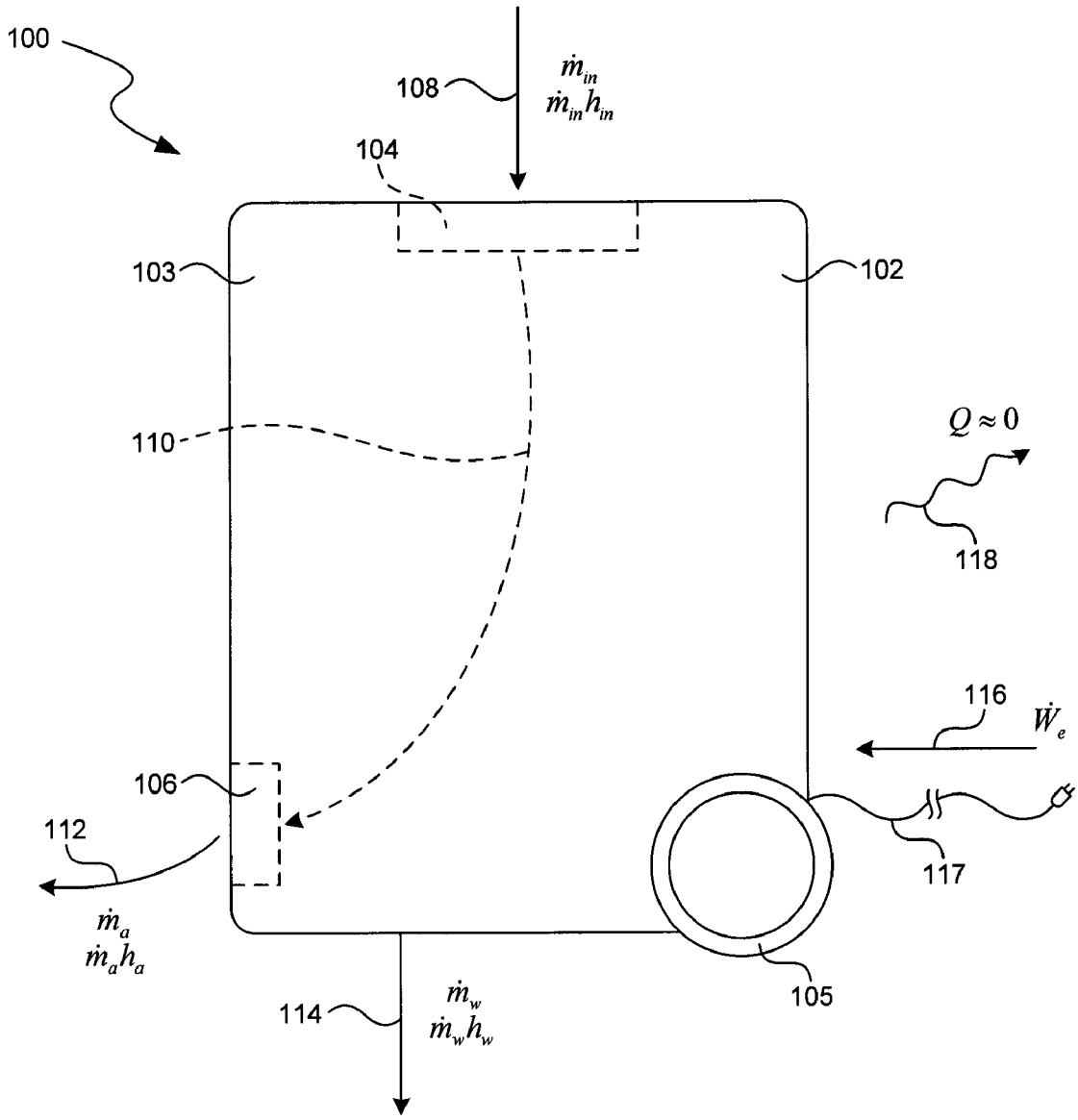
FIG. 1 is a schematic diagram of a dehumidifier that is used to illustrate several methods, systems, and apparatuses configured in accordance with embodiments of the disclosure.

The present disclosure is directed generally to methods, systems, and/or apparatuses for determining the performance of a dehumidifier. FIG. 1, for example, is a schematic diagram of a system 100 including a dehumidifier 102 that is used to describe several embodiments and features of the disclosure. As shown in FIG. 1, the dehumidifier 102 includes a cabinet or housing 103 with an inlet portion 104 and an outlet portion 106. As will be appreciated by one of ordinary skill in the relevant art, the dehumidifier 102 can include several components associated with conventional dehumidifiers. For example, the dehumidifier 102 can include a refrigeration cycle that moves a refrigerant through at least a compressor, a condenser, an expansion device, and an evaporator so that airflow can pass through at least the evaporator and the condenser to remove moisture from the airflow. As shown in the illustrated embodiment, for example, airflow represented by a first arrow 108 enters the inlet portion 104 of the dehumidifier 102. Airflow represented by a second arrow 110 (shown in broken lines) inside the housing 103 passes through one or more of the moisture removing components (e.g., the evaporator) of the dehumidifier 102 and exits the housing 103 from the outlet portion 106 as indicated by a third arrow 112. Although airflow represented by the second arrow 110 passing through the dehumidifier 102 is shown as passing directly from the inlet portion 104 to the outlet portion 106, one of ordinary skill in the relevant art will appreciate that airflow inside the dehumidifier 102 can include various different paths, including for example, curved, looped, straight, and/or divergent paths passing over the various moisture removing components of the dehumidifier 102. As will also be appreciated by one of ordinary skill in the relevant art, the dehumidifier 102 illustrated in FIG. 1 can include any type of dehumidifier, including, for example, a commercial, industrial, residential, or personal dehumidifier.

In addition to the airflow paths, FIG. 1 also illustrates various properties associated with the system 100. More specifically, FIG. 1 illustrates several properties of airflow passing through the dehumidifier 102, including, for example, mass flow values. At the first arrow 108, the mass flow rate $\dot{m}_{in}$ into the dehumidifier 102 includes the mass flow rate of the air, as well as the mass flow rate of the moisture carried by the air, into the dehumidifier 102. The mass flow rate out of the dehumidifier 102 is separated into the mass flow rate of dry air $\dot{m}_a$ exiting the dehumidifier at the third arrow 112, and the mass flow rate of the moisture $\dot{m}_w$ (e.g., liquid condensate) collected and removed from the air exiting the dehumidifier at a fourth arrow 114.

In addition to the mass flow balance, FIG. 1 also illustrates an energy balance associated with the dehumidifier 102. More specifically, airflow energy $\dot{m}_{in}h_{in}$ into the dehumidifier 102 is at the first arrow 108, where $_{in}$ is the enthalpy of the airflow entering the dehumidifier 102. Electrical energy $\dot{W}_e$ is also added to the dehumidifier 102 at a fifth arrow 116 from a power source, for example, via a power cord 117. The energy exiting the dehumidifier 102 is separated into the dry air energy $\dot{m}_a h_a$ exiting the dehumidifier 102 at the third arrow 112, and the moisture energy $\dot{m}_w h_w$ exiting the dehumidifier 102 at the fourth arrow 114, where $h_w$ is the enthalpy of liquid condensate exiting the dehumidifier 102. As is also shown in FIG. 1 at a sixth arrow 118, heat or energy loss $\dot{Q}_{out}$ out of the dehumidifier is considered to be negligible. This assumption of negligible heat loss $\dot{Q}_{out}$ is made due to the fact that the dry air energy $\dot{m}_a h_a$ and the moisture energy $\dot{m}_w h_w$ leaving the dehumidifier 102 are much greater than the thermal energy losses $\dot{Q}_{out}$ convected away from the dehumidifier 102 by the ambient air surrounding the dehumidifier 102.

Figure 2:
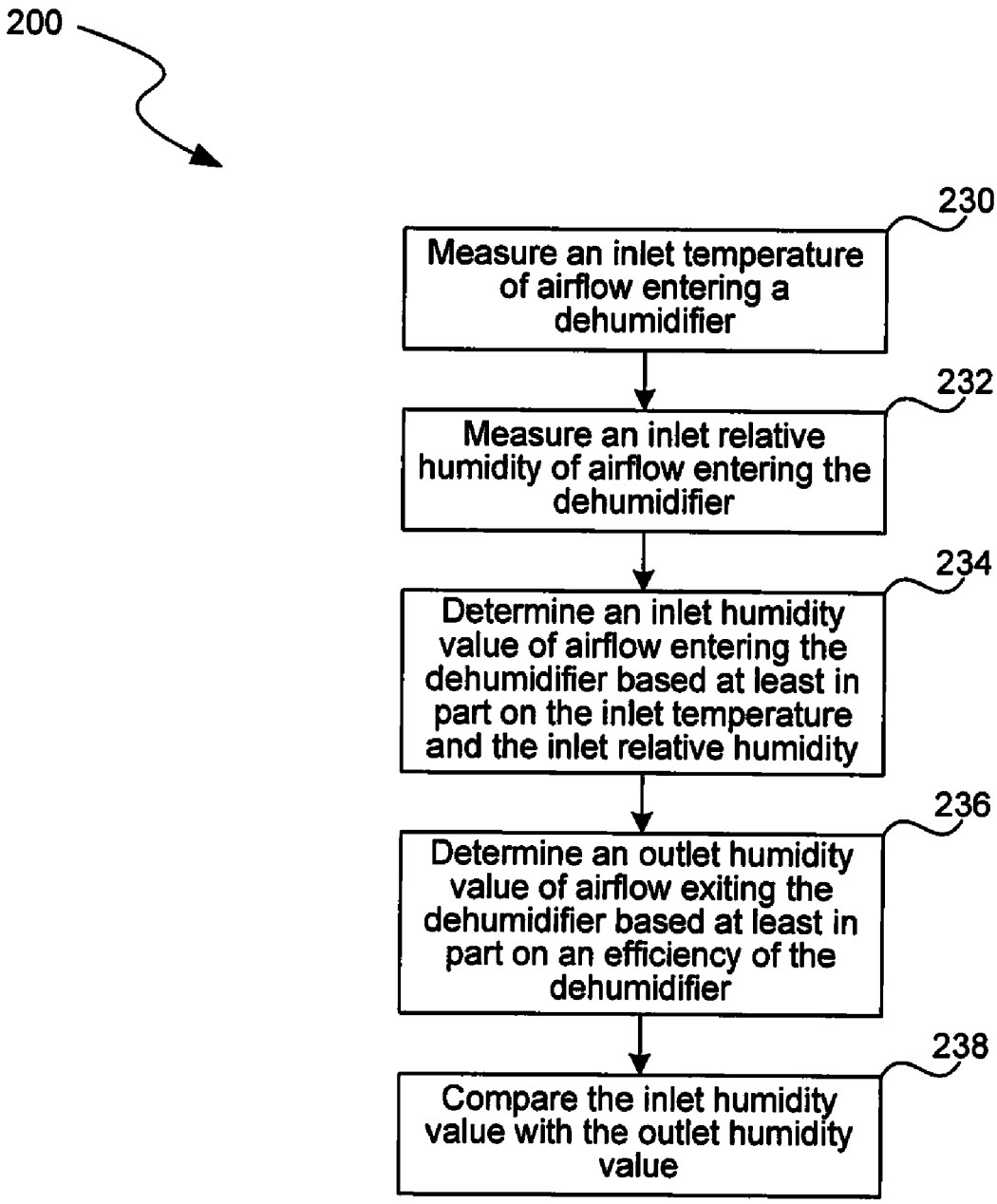
FIG. 2 is a flow diagram of a method for determining dehumidifier performance in accordance with an embodiment of the disclosure.

FIG. 2 is a flow diagram of a process or method 200 configured in accordance with an embodiment of the disclosure for determining the performance of the dehumidifier 102 of FIG. 1. Although the method 200 illustrated in FIG. 2 is at least partially described with reference to the dehumidifier 102 of FIG. 1, the method 200 can be used with any type of dehumidifier. The method 200 includes measuring an inlet temperature of airflow entering a dehumidifier (block 230) and measuring an inlet relative humidity of airflow entering the dehumidifier (block 232). The measurements of these "inlet" properties of airflow are intended to refer to measurements of the airflow before the airflow passes through the moisture removing components (e.g., upstream from the evaporator) of the dehumidifier. Referring to FIG. 1, for example, the inlet temperature and inlet relative humidity of the airflow at the first arrow 108 can be measured at the inlet portion 104 of the dehumidifier 102. The inlet portion 104 can include any location proximate to the housing 103, including for example, at an inlet vent or opening, inside the housing, or other "upstream" locations within the housing. In other embodiments, however, the inlet temperature and inlet relative humidity can be measured at an upstream location external to the housing 103 of the dehumidifier. For example, the inlet temperature and inlet relative humidity can be measured before the airflow enters the housing 103 at the inlet portion 104. Moreover, the inlet temperature and the inlet relative humidity can be measured with any device or component suitable for measuring these properties of airflow, including for example, hygrometers, thermocouples, heat sensors, thermometers, etc. In addition, as explained below with reference to FIG. 5, these measuring or sensing devices can be carried by the dehumidifier 102 or separate portable components that are movable relative to the dehumidifier 102.

Referring again to FIG. 2, the method 200 further includes determining an inlet humidity value of airflow entering the dehumidifier based on the inlet temperature and the inlet relative humidity (block 234). In certain embodiments, the inlet humidity value is the humidity ratio of the airflow entering the dehumidifier (e.g., the ratio of the partial pressure of water vapor in a volume of air to the saturated vapor pressure of water vapor in the volume of air at a prescribed temperature). Certain details of the steps for determining the inlet relative humidity are described below, in particular, with reference to equation (7) and the other related equations.

The method 200 further includes determining an outlet humidity value of airflow exiting the dehumidifier (block 236). In certain embodiments, the outlet humidity value corresponds to the outlet humidity ratio of the airflow exiting the dehumidifier. Determining the outlet humidity value can include measuring an outlet temperature of the airflow exiting the dehumidifier. The "outlet" properties including the outlet temperature refer to properties of the airflow after the airflow has passed through the moisture removing components of the dehumidifier (e.g., "downstream" from the evaporator). Referring to FIG. 1, for example, the outlet temperature of the airflow at the third arrow 112 can be measured at the outlet portion 106 of the dehumidifier 102, which can include any location proximate to the housing 103. In other embodiments, however, the outlet temperature of the airflow can be measured at a location external to or spaced apart from the housing 103, in a manner generally similar to that described above with reference to the inlet properties.

As explained below in greater detail below with reference to FIGS. 3 and 4, one benefit of the method 200 of FIG. 2 is that the method 200 determines the outlet humidity value without measuring an outlet relative humidity of airflow exiting the dehumidifier. Determining the outlet humidity value without a measured outlet relative humidity provides several advantages. For example, the dehumidifier performance determined from the method 200 is expected to be more accurate than a method involving a measurement of an outlet relative humidity, because a measured outlet relative humidity is typically inaccurate. More specifically, measuring an outlet relative humidity often gives inaccurate results due to the elevated outlet temperature of airflow exiting the dehumidifier. As airflow passes through a dehumidifier, a condenser typically heats the airflow before the airflow exits the dehumidifier, and the elevated temperature of airflow downstream from the condenser introduces errors into the measurement of the outlet relative humidity. Moreover, a relatively small error in the measurement of the outlet relative humidity is compounded by the calculation for the outlet humidity ratio that is based on the measured outlet relative humidity and the outlet temperature.

The method 200 illustrated in FIG. 2, however, determines the outlet humidity value based at least in part on a performance factor or efficiency of the dehumidifier, and without a measured outlet relative humidity. More specifically, and as explained in greater detail below with reference to FIGS. 3 and 4, the method 200 can determine the outlet humidity value based at least in part on energy consumed by the dehumidifier in terms of the current drawn by the dehumidifier, and/or a moisture removal mass flow rate through the dehumidifier. Determining the outlet humidity value based at least in part on the current drawn by the dehumidifier and/or a moisture removal mass flow rate avoids the problems described above when calculating the outlet humidity ratio based at least in part on the measured outlet relative humidity.

After determining the inlet humidity value and the outlet humidity value, the method 200 further includes comparing the inlet and outlet humidity values (block 238). The difference between the inlet and outlet humidity values provides an indication of the amount of moisture that a dehumidifier removes from the airflow passing through the dehumidifier (commonly called the grain depression of the dehumidifier). Accurately determining the performance of a dehumidifier provides several benefits. One benefit, for example, is an accurate indication of the amount of water removed in a water restoration project or other application. Another benefit includes accurately representing the amount of water removal to a party who is paying for the dehumidification (e.g., a property insurer) based on the amount of water removal.

Figure 3:
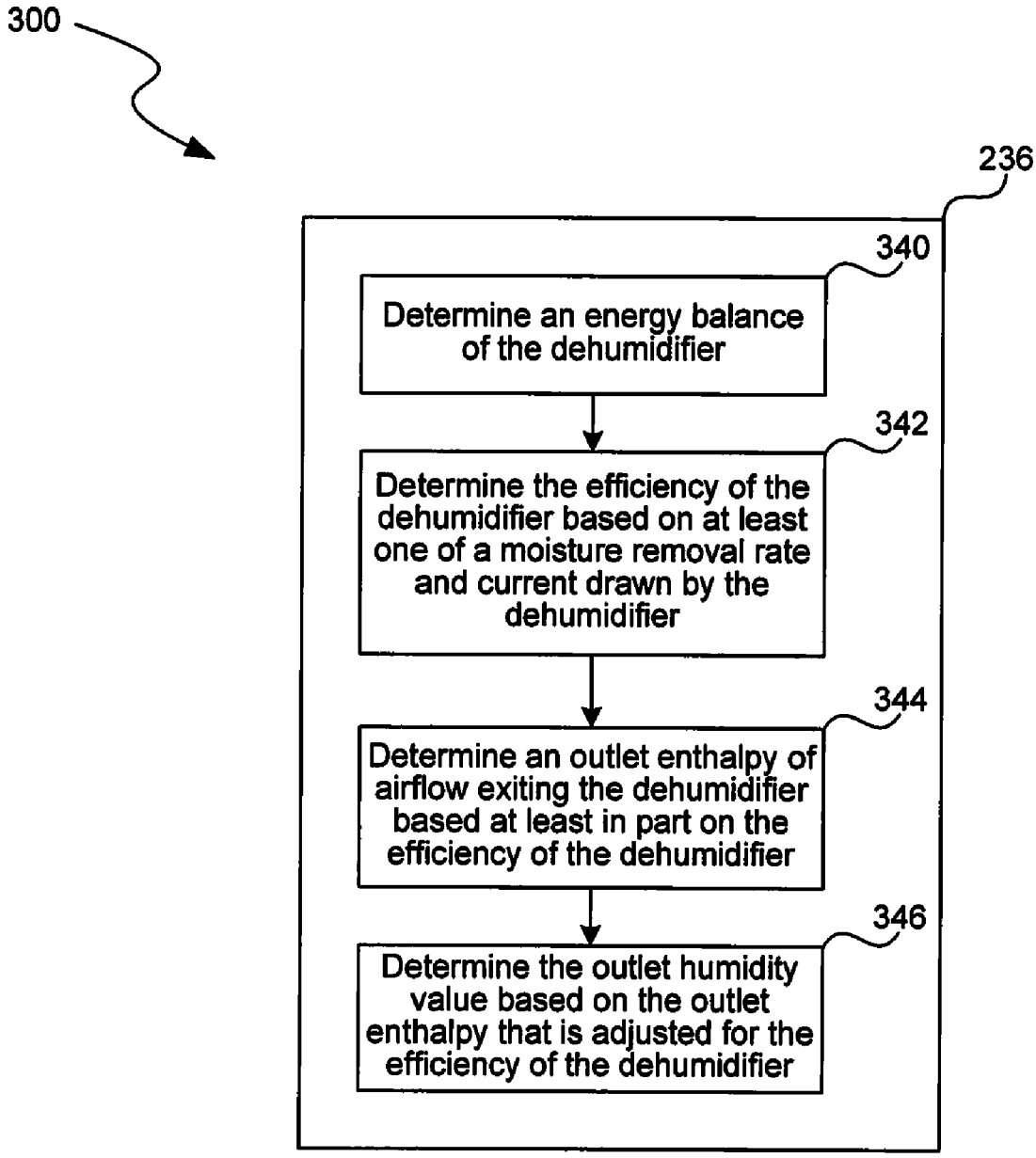
FIGS. 3 and 4 are flow diagrams of sub-methods of the method of FIG. 2 for determining dehumidifier performance in accordance with embodiments of the disclosure.

FIG. 3 is a schematic diagram of a sub-method 300 configured in accordance with an embodiment of the disclosure for determining the outlet humidity value (e.g., the outlet humidity ratio) in block 236 of FIG. 2. More specifically, the method 300 illustrated in FIG. 3 includes a conservation of energy approach to determining the outlet humidity value of the dehumidifier that takes into account the performance factor or efficiency of the dehumidifier. For example, the method 300 includes determining an energy balance of the dehumidifier (block 340). Referring to FIG. 1, for example, the mass flow balance of the dehumidifier 102 can be expressed by the equation:

$$\dot{m}_{in}=\dot{m}_w+\dot{m}_a \tag{1}$$

where, as noted above, $\dot{m}_{in}$ refers to the total mass flow rate of air and moisture carried by the air entering the dehumidifier 102, $\dot{m}_w$ refers to the mass flow rate of moisture (e.g., condensate) removed from airflow exiting the dehumidifier 102, and $\dot{m}_a$ refers to the mass flow rate of dry air exiting the dehumidifier 102.

Also referring to FIG. 1, an energy balance of the dehumidifier 102 can be expressed by the equation:

$$\dot{m}_{in}h_{in}+\dot{W}_e=\dot{m}_w h_w+\dot{m}_a h_a \tag{2}$$

where, as noted above, $\dot{m}_{in}h_{in}$ represents the energy of the air and moisture carried by the air entering the dehumidifier, $\dot{W}_e$ represents the electrical energy supplied to the dehumidifier, $\dot{m}_w h_w$ represents the energy of the moisture (e.g., condensate) removed from airflow passing through the dehumidifier, and $\dot{m}_a h_a$ represents the energy from the dry air exiting the dehumidifier. As noted above, $\dot{Q}$ represents the energy lost from the dehumidifier 102 and is assumed to be negligible and therefore omitted from equation (2). In other embodiments, the energy lost $\dot{Q}$ may be not negligible, and in such cases it can be measured or estimated and included as part of the performance calculation. Solving equation (1) for the dry air mass flow rate $\dot{m}_a$ and substituting the dry air mass flow rate $\dot{m}_a$ into equation (2) can be expressed by the equation:

$$\dot{m}_{in}h_{in}+\dot{W}_e=\dot{m}_w h_w+(\dot{m}_{in}-\dot{m}_w)h_a \tag{2}$$

Solving equation (3) for the outlet enthalpy $h_a$ of the dry air exiting the dehumidifier can be expressed by the equation:

$$h_a=\frac{(\dot{m}_{in}h_{in}+\dot{W}_e-\dot{m}_w h_w)}{(\dot{m}_{in}-\dot{m}_w)} \tag{4}$$

As described below, each of the variables in equation (4) can be determined to provide a value for the outlet enthalpy $h_a$ of the dry air, without measuring an outlet relative humidity of the airflow. For example, the total mass flow rate $\dot{m}_{in}$ can be expressed by the equation:

$$\dot{m}_{in}=\frac{\dot{V}_{in}}{v_{in}} \tag{5}$$

where $\dot{V}_{in}$ is the inlet volumetric flow rate of the airflow in $ft^3$/min, and $v_{in}$ is the inlet specific volume of the airflow in $ft^3$/lbm. The specific volume $v_{in}$ is a function of the inlet temperature and the inlet humidity ratio as expressed by the equation:

$$v_{in}=\frac{(T_{in}+459.67)(1+1.6078W_{in})}{39.667} \tag{6}$$

where $T_{in}$ is the airflow inlet temperature in ° F., 459.67 is a conversion factor from degrees Fahrenheit to Rankin, $W_{in}$ is the inlet humidity ratio, 1.6078 is the mole fraction ratio of dry air to water, and 39.667 is the value of the product of the molecular mass of dry air and the atmospheric pressure in inches Hg.

The inlet humidity ratio $W_{in}$ is a function of the partial pressure of water as expressed by the equation:

$$W_{in}=0.62198\frac{p_w}{(14.696-p_w)} \tag{7}$$

where $p_w$ is the partial pressure of water, 0.62198 is the inverse of the mole fraction ratio of dry air to water, and 14.696 is atmospheric pressure in psi. The partial pressure $p_w$ of water is defined as a function of the inlet relative humidity and saturation partial pressure of water as expressed by the equation:

$$p_w=\phi_{in}p_{ws} \tag{8}$$

where $\phi_{in}$ is the relative humidity of the airflow at the inlet, and $p_{ws}$ is the saturation partial pressure of water.

The saturation partial pressure of water $p_{ws}$ is a function of the inlet temperature according to the Hyland-Wexler Correlation (1983) as expressed by the equation:

$$\ln p_{ws} = \frac{C_1}{T_{in}} + C_2 + C_3 T_{in} + C_4 T_{in}^2 + C_5 T_{in}^3 + C_6 \ln T_{in} \tag{9}$$

where $C_1=-1.0440397(10^4)$, $C_2=-1.129465(10^1)$, $C_3=-2.7022355(10^{-2})$, $C_4=-1.289036(10^{-5})$, $C_5=-2.478068(10^{-9})$, and $C_6=-6.5459673(10^0)$.

Alternatively, for temperatures between 64-102° F., a polynomial fit that is accurate to within 1% may be used to determine the saturation partial pressure of water $p_{ws}$, as expressed by the equation:

$$p_{ws}=0.000268T_{in}^2-0.02615T_{in}+0.88258 \tag{10}$$

Based on equations (5)-(10), the value of the inlet mass flow rate $\dot{m}_{in}$ of equation (4) can be determined based on known values (e.g., constants, functions, and/or empirical data) and measured inlet temperature.

Turning next to the inlet enthalpy $h_{in}$ of equation (4), the enthalpy of a mixture of perfect gases equals the sum of the individual partial enthalpies of the individual gases. Therefore, the specific enthalpy of moist air h can be expressed by the equation:

$$h=h_{da}+Wh_g \tag{11}$$

where $h_{da}$ is the specific enthalpy for dry air in Btu/$lb_{da}$, W is the humidity ratio, and $h_g$ is the specific enthalpy for saturated water vapor in Btu/$lb_w$ at the temperature of the mixture. These enthalpies can be expressed by the following approximations:

$$h_{da}\approx 0.240t \tag{12}$$

$$h_g=1061+0.44t \tag{13}$$

where t is the dry bulb temperature in ° F. Substituting equations (12) and (13) into equation (11) to solve for the inlet enthalpy $h_{in}$ is expressed by the equation:

$$h_{in}=0.240T_{in}+W_{in}(1061+0.444T_{in}) \tag{14}$$

where $W_{in}$ is known from equation (7) above.

Turning next to the inlet electrical energy $\dot{W}_e$ of equation (4), the inlet electrical energy $\dot{W}_e$ can be expressed by the equation:

$$\dot{W}_e=AVP.F. \tag{15}$$

where A represents the current drawn by the dehumidifier in amps, V represents the voltage provided to the dehumidifier, and P.F. represents the power factor of the dehumidifier accounting for the phase lag between the voltage and current.

Turning next to the mass flow rate $\dot{m}_w$ of the moisture of equation (4), to solve for the mass flow rate $\dot{m}_w$ of the moisture, the inventors have derived a correction or performance factor $\epsilon$ for the dehumidifier. The performance factor $\epsilon$ is expressed by the equation:

$$\varepsilon = \frac{\dot{m}_w}{A} \tag{16}$$

The performance factor $\epsilon$ is intended to provide an indication of a type of efficiency of the dehumidifier based on the moisture mass flow rate $\dot{m}_w$ removed by the dehumidifier from the airflow and the current A drawn by the dehumidifier. Accordingly, the performance factor or efficiency $\epsilon$ is consistent with the units of the mass flow rate $\dot{m}_w$ the current A, and can be expressed in units of mass per charge. This step in the analysis is included at block 342 in the method 300 illustrated in FIG. 3. Rearranging equation (16), the moisture mass flow rate $\dot{m}_w$ is expressed by the equation:

$$\dot{m}_w=\epsilon A \tag{17}$$

Accordingly, the product of the performance factor or efficiency $\epsilon$ and the current A can be substituted for the moisture mass flow rate $\dot{m}_w$ into equation (4) such that the outlet enthalpy of the dry air $h_a$ is a function of at least the current A drawn by the dehumidifier.

Turning next to the condensate enthalpy $h_w$ (i.e., the enthalpy of the moisture removed from the airflow in the dehumidifier) in equation (4), the condensate is assumed to be at the dew point temperature of the airflow since the water vapor in the airflow condenses at the dew point temperature as the airflow passes through the moisture removing device (e.g., the evaporator) of the dehumidifier. Based on this assumption, the condensate enthalpy $h_w$ is expressed by the equation:

$$h_w\approx h_{fin,Td}=T_{d,in}-32 \tag{18}$$

where $h_{fin,Td}$ is the condensate enthalpy at the dew point temperature in ° F., $T_{d,in}$ is the dew point temperature in ° F., and 32 is a conversion factor. The dew point temperature $T_{d,in}$ is a function of the saturation partial pressure $p_w$ of water and is expressed by the equation:

$$T_{d,in}=100.45+33.193(\ln p_w)+2.319(\ln p_w)^2+0.17074(\ln p_w)^3+1.2063\,p_w^{0.1984} \tag{19}$$

With equations (5)-(19), each of the variables in equation (4) has been defined in terms of measurable properties, thereby providing a method of determining the outlet enthalpy $h_a$ of the air exiting the dehumidifier. As explained above with reference to equations (16) and (17), the outlet enthalpy $h_a$ of the exiting air is adjusted by the efficiency or performance factor $\epsilon$, which adjusts the outlet enthalpy $h_a$ according to at least the current A drawn by the dehumidifier.

After determining the value for each variable in equation (4), including the efficiency $\epsilon$ of the dehumidifier based at least in part on the current A drawn by the dehumidifier and the moisture mass flow rate $\dot{m}_w$ removed by the dehumidifier, the method 300 further includes determining the outlet humidity ratio $W_{out}$ based at least in part on the adjusted outlet enthalpy $h_a$ (block 344). As described above with reference to equation (14), the outlet enthalpy $h_a$ of the dry air can be expressed by the equation:

$$h_a=0.240T_{out}+W_{out}(1061+0.444T_{out}) \tag{20}$$

Rearranging equation (20) for the outlet humidity ratio $W_{out}$ is expressed by the equation:

$$W_{out} = \frac{(h_a - 0.240T_{out})}{(1061 + 0.444T_{out})} \tag{21}$$

Accordingly, with equation (21), the outlet humidity ratio $W_{out}$ determined by the method 300 is a function of the outlet enthalpy $h_{out}$, which as described above has been determined based at least in part on the efficiency or performance factor $\epsilon$ of the dehumidifier. The outlet humidity ratio $W_{out}$ can then be compared win the inlet humidity ratio $W_{in}$ to determine the performance of the dehumidifier. As a result, the energy balance described above with reference to FIG. 3 provides a method of determining the dehumidifier performance with measurements of the inlet temperature and inlet relative humidity of airflow, the outlet temperature of airflow, the energy consumed in terms of the current drawn through the dehumidifier, and without measuring the outlet relative humidity. In certain embodiments, other values of the properties discussed above can be determined empirically.

Figure 4:
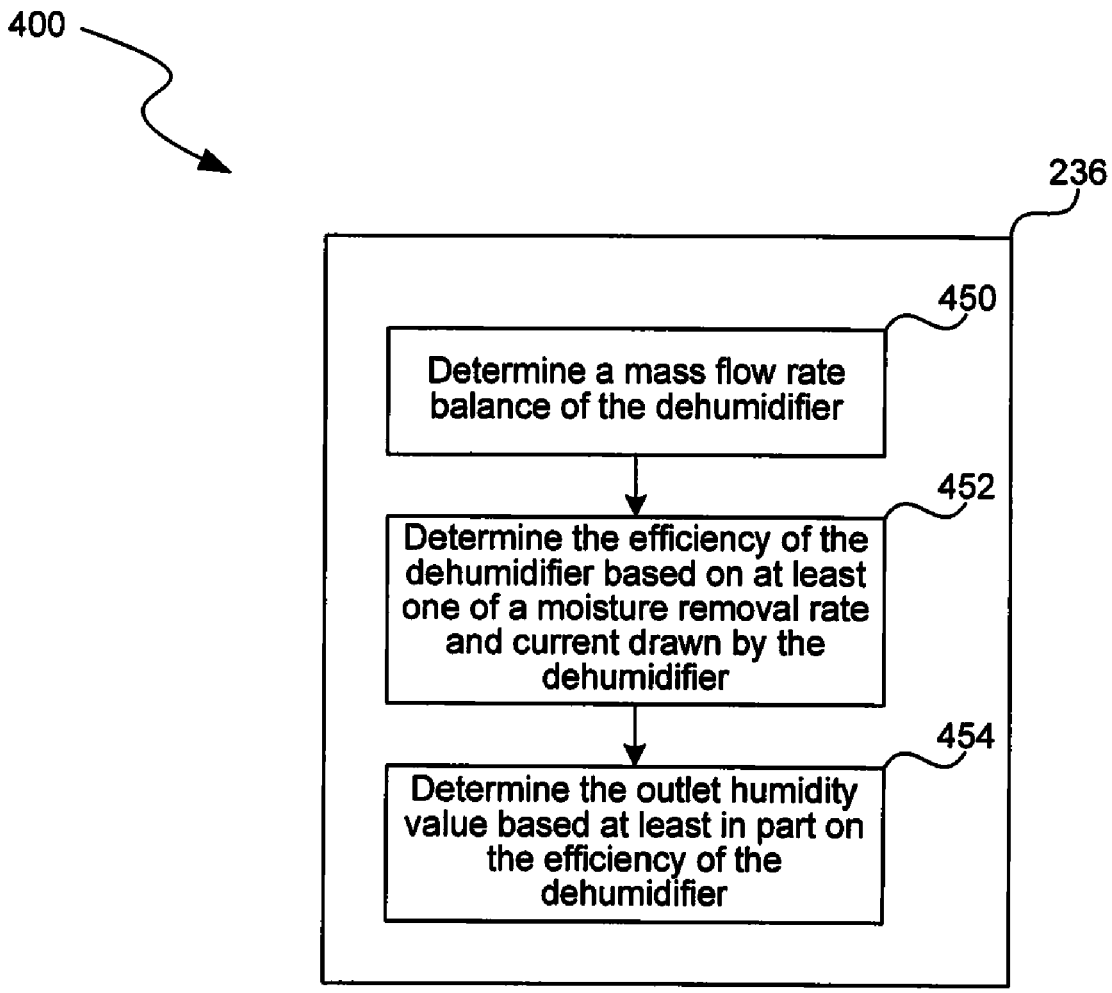

FIG. 4 is a schematic diagram of a sub-method 400 configured in accordance with another embodiment of the disclosure for determining the outlet humidity value (e.g., the outlet humidity ratio) in block 236 of FIG. 2. More specifically, the method 400 includes a conservation of mass approach to determining the outlet humidity value of the dehumidifier, rather than a conservation of energy approach. For example, the method 400 includes determining a mass flow balance of the dehumidifier (block 450). Referring again to FIG. 1, for example, the mass flow balance of the dehumidifier 102 can be expressed by the equation (1) above. Separating the mass flow rates of air and moisture, respectively, from equation (1) can be expressed by the equations:

$$\dot{m}_{inda}=\dot{m}_{outda} \tag{22}$$

$$\dot{m}_{inw}=\dot{m}_{w}+\dot{m}_{outw} \tag{23}$$

where $\dot{m}_{inda}$ is the mass flow rate of dry air entering the dehumidifier, $\dot{m}_{outda}$ is the mass flow rate of dry air exiting the dehumidifier, $\dot{m}_{inw}$ is the mass flow rate of moisture carried by the airflow into the dehumidifier, $\dot{m}_{w}$ is the mass flow rate of condensate out of the dehumidifier, and $\dot{m}_{outw}$ is the mass flow rate of moisture carried by the airflow out of the dehumidifier.

A humidity ratio W is generally defined as the ratio of the mass flow rate of moisture carried by air $\dot{m}_{wa}$ and the mass flow rate of dry air $\dot{m}_{da}$ as expressed by the equation:

$$W=\frac{\dot{m}_{wa}}{\dot{m}_{da}} \tag{24}$$

Solving equation (24) for the mass flow of moisture carried by air $\dot{m}_{wa}$ is expressed by the equation:

$$\dot{m}_{wa}=W\dot{m}_{da} \tag{25}$$

Substituting the mass flow rate of moisture carried by the air $\dot{m}_{wa}$ of equation (25) into the mass flow rates including moisture carried by the air into equation (23) is expressed by the equation:

$$W_{in}\dot{m}_{da}=\dot{m}_{w}+W_{out}\dot{m}_{da} \tag{26}$$

Solving equation (26) for $W_{out}$ is expressed by the equation:

$$W_{out}=W_{in}-\frac{\dot{m}_{w}}{\dot{m}_{inda}} \tag{27}$$

The method 400 illustrated in FIG. 4 also includes determining the efficiency or correction factor $\epsilon$ (block 452), which is defined in equation (16). After finding the correction factor or efficiency $\epsilon$, the method 400 further includes determining the outlet humidity value (e.g., humidity ratio) based at least in part on the efficiency $\epsilon$ of the dehumidifier (block 454). More specifically, equation (27) can be manipulated to substitute in the mass flow rate of dry air $\dot{m}_{inda}$ from equation (5), and the mass flow rate of moisture $\dot{m}_{w}$ from equation (17) above based on the efficiency or correction factor $\epsilon$, which can be expressed by the equation:

$$W_{out}=W_{in}-\frac{\varepsilon A v_{in}}{\dot{V}_{in}} \tag{28}$$

where the inlet humidity ratio $W_{in}$ is defined by equation (7) above and the specific volume $v_{in}$ is defined by equation (6) above. Moreover, the term $$\frac{\varepsilon}{\dot{V}_{in}}$$

is a constant expressed by pints/day/amps/SCFM/1381, where 1381 is a conversion factor for consistent units. The values of the efficiency or correction factor $\epsilon$ and $\dot{V}_{in}$ can be determined empirically for different dehumidifiers. In this manner, the outlet humidity ratio $W_{out}$ is expressed as a function of the current A drawn by the system. As a result, the mass flow balance described above with reference to FIG. 4 provides a method of determining the dehumidifier performance with measurements of the inlet temperature and inlet relative humidity of airflow, the outlet temperature of airflow, the current drawn through the dehumidifier, and without measuring the outlet relative humidity.

Figure 5:
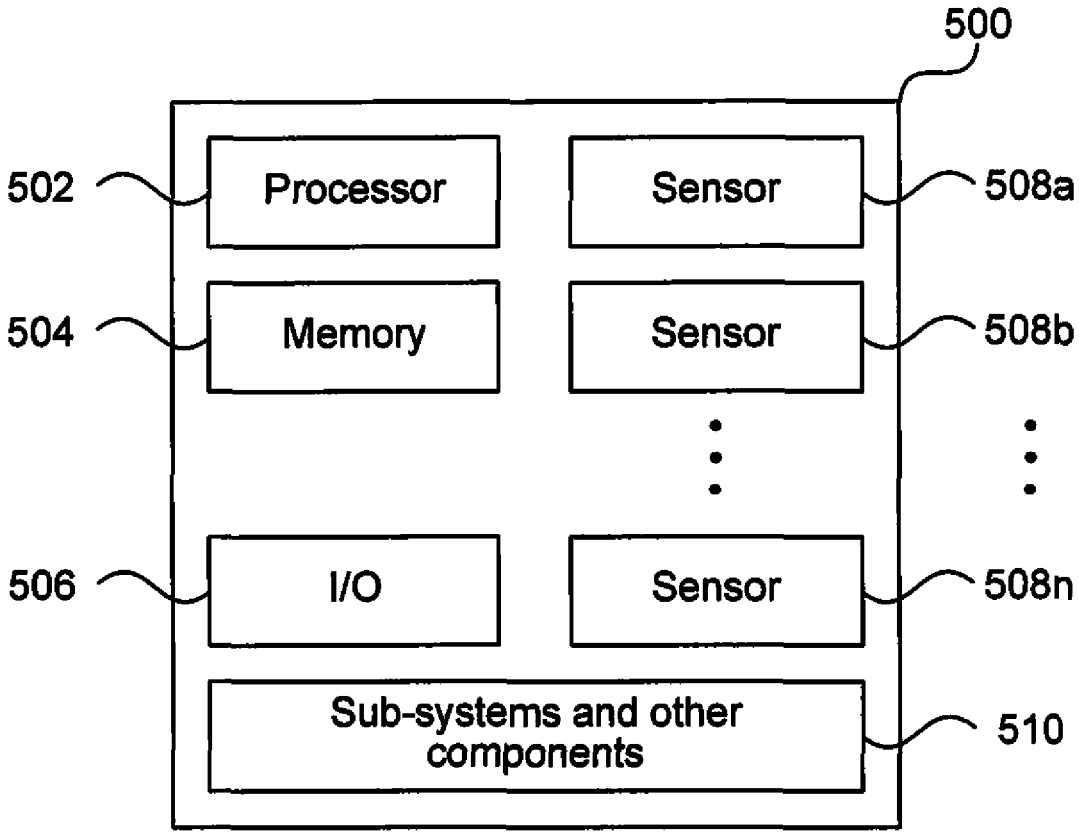
FIG. 5 is a schematic diagram of a system configured in accordance with an embodiment of the disclosure for determining dehumidifier performance.

Any of the methods described above with reference to FIGS. 1-4 can be incorporated into any apparatus or system for determining the performance of a dehumidifier. FIG. 5, for example, is a schematic diagram of an apparatus or system 500 configured in accordance with an embodiment of the disclosure for determining the performance of a dehumidifier. The system 500 can include a processor 502, a memory 504, input/output devices 506, one or more sensors 508 (individually identified as a first sensor, 508*a*, a second sensor 508*b* . . . and an nth sensor 508*n*), and/or other subsystems or components 510 (displays, speakers, communication modules, etc.). The sensors 508 are configured to measure or detect properties of the dehumidifier and the air flowing through the dehumidifier. For example, the sensors 508 can measure the inlet temperature, inlet relative humidity, outlet temperature, etc. of airflow passing through the dehumidifier, the current drawn by the dehumidifier, and/or any other properties associated with the dehumidifier and/or airflow. The memory 504 can include computer readable media including instructions thereon to perform the methods for determining dehumidifier performance as described herein. Moreover, the processor 502 is configured for performing the instructions, calculations, and any other parameters associated with the methods described herein.

In certain embodiments, the system 500 can be incorporated into a portable apparatus, such as a handheld device, for determining the performance of a dehumidifier. For example, a user can position the system 500 at different positions relative to a dehumidifier to measure the corresponding properties to determine the dehumidifier performance, such as the inlet temperature, inlet relative humidity, outlet temperature, current drawn, or any other property or characteristic associated with the dehumidifier. The system 500 is also configured to determine the performance of the dehumidifier based on these measured properties, any of equations (1)-(28) above, and/or any other empirical data associated with the dehumidifier. In other embodiments, however, the system 500 can be onboard with a dehumidifier or otherwise carried by a dehumidifier. For example, referring to the dehumidifier 102 in FIG. 1, one or more sensors can be positioned at the inlet portion 104, the outlet portion 106, or any other suitable location for measuring the corresponding properties (e.g., upstream or downstream from the moisture removing components of the dehumidifier). In this manner, the dehumidifier can determine its own performance and display and indication of its performance.

From the foregoing, it will be appreciated that specific embodiments have been described herein for purposes of illustration, but that various modifications may be made without deviating from the disclosure. For example, one or more systems or apparatuses described herein can be configured to communicate wirelessly with one another or separate dehumidifiers. More specifically, a dehumidifier including one or more sensors can wirelessly transmit the relevant measured properties to a handheld device for determining the dehumidifier performance. Moreover, aspects described in the context of particular embodiments may be combined or eliminated in other embodiments. Further, although advantages associated with certain embodiments have been described in the context of those embodiments, other embodiments may also exhibit such advantages, and not all embodiments need necessarily exhibit such advantages to fall within the scope of the disclosure. Accordingly, the disclosure is not limited except as by the appended claims.

We claim:

1. A method of determining dehumidifier performance, the method comprising:

determining a first humidity value of airflow entering the dehumidifier;

measuring an electrical current drawn by the dehumidifier;

using the measured electrical current, determining an efficiency of the dehumidifier;

based at least in part on the efficiency of the dehumidifier, determining a second humidity value of airflow exiting the dehumidifier; and determining, with a processor, a difference between the first humidity value and the second humidity value.

2. The method of claim 1, further comprising:

measuring a first temperature of airflow entering the dehumidifier;

measuring a first relative humidity of airflow entering the dehumidifier, wherein determining the first humidity value comprises calculating the first humidity value based at least in part on the first temperature and the first relative humidity; and determining the efficiency of the dehumidifier based at least in part on a moisture removal rate of the dehumidifier.

3. The method of claim 2, further comprising measuring a second temperature of airflow exiting the dehumidifier and determining an enthalpy of airflow exiting the dehumidifier, wherein determining the second humidity value comprises determining the second humidity value based at least in part on the efficiency, the second temperature, and the enthalpy of airflow exiting the dehumidifier.

4. The method of claim 1 wherein determining the second humidity value comprises determining the second humidity value based at least in part on the efficiency of the dehumidifier and an energy balance of the dehumidifier.

5. The method of claim 1 wherein determining the second humidity value comprises determining the second humidity value based at least in part on the efficiency of the dehumidifier and a mass flow balance of moisture and air passing through the dehumidifier.

6. The method of claim 1 wherein determining the first humidity value comprises:

measuring a first temperature of airflow entering the dehumidifier;

measuring a first relative humidity of airflow entering the dehumidifier; and calculating the first humidity value based on the first temperature and the first relative humidity.

7. The method of claim 1 wherein determining the second humidity value comprises determining the second humidity value without measuring a relative humidity of airflow exiting the dehumidifier.

8. The method of claim 1 wherein determining the efficiency of the dehumidifier further comprises determining the efficiency based at least in part on a moisture removal rate of the dehumidifier.

9. The method of claim 1 wherein determining the second humidity value comprises determining an enthalpy of airflow exiting the dehumidifier, wherein the enthalpy is based at least in part on the efficiency of the dehumidifier.

10. The method of claim 1 wherein the first humidity value is a first humidity ratio of a first mass of moisture and a first mass of dry air entering the dehumidifier, and the second humidity value is a second humidity ratio of a second mass of moisture and a second mass of dry air exiting the dehumidifier.

11. The method of claim 1, further comprising providing a performance value of the dehumidifier based on at least one of a moisture removal rate and energy consumed by the dehumidifier.

12. A method of evaluating dehumidifier performance, the method comprising:

measuring an inlet temperature of airflow at an inlet of a dehumidifier;

measuring a relative humidity of airflow at the inlet of the dehumidifier;

determining an inlet humidity ratio of airflow at the inlet of the dehumidifier based on the inlet temperature and the inlet relative humidity;

determining an outlet humidity ratio of airflow at an outlet of the dehumidifier using an efficiency of the dehumidifier, and wherein the efficiency is determined using a measured electrical current drawn by the dehumidifier; and comparing, with a processor, the inlet humidity ratio with the outlet humidity ratio to determine an amount of moisture removed by the dehumidifier from airflow passing through the dehumidifier.

13. The method of claim 12 wherein determining the outlet humidity ratio comprises determining the outlet humidity ratio based at least in part on the efficiency based at least in part on a moisture removal rate and current drawn by the dehumidifier.

14. The method of claim 12, further comprising determining the efficiency of the dehumidifier based at least in part on a moisture removal rate and current drawn by the dehumidifier.

15. The method of claim 12, further comprising:

measuring an outlet temperature of airflow at the outlet of the dehumidifier; and determining an outlet enthalpy of airflow at the outlet of the dehumidifier based at least in part on the efficiency of the dehumidifier, wherein determining the outlet humidity ratio comprises determining the outlet humidity ratio based at least in part on the outlet temperature and the outlet enthalpy.

16. The method of claim 12 wherein determining the outlet humidity ratio comprises determining the outlet humidity ratio based at least in part on a mass flow balance of moisture and air passing through the dehumidifier.

17. The method of 16, further comprising determining the efficiency of the dehumidifier based at least in part on a moisture removal rate of the dehumidifier.

18. A method of determining dehumidifier performance, the method comprising:

determining a first humidity ratio of airflow entering the dehumidifier based at least in part on an inlet temperature and a relative humidity of airflow entering the dehumidifier;

measuring an electrical current drawn by the dehumidifier;

using the measured electrical current, determining an efficiency of the dehumidifier based on a moisture removal rate of the dehumidifier;

determining a second humidity ratio of airflow exiting the dehumidifier based at least in part on the efficiency of the dehumidifier, wherein the second humidity ratio is determined without measuring an outlet relative humidity of airflow exiting the dehumidifier; and comparing, with a processor, the first humidity ratio and the second humidity ratio.

19. The method of claim 18 wherein determining the second humidity ratio includes determining the second humidity ratio based on at least one of an energy balance of the dehumidifier and a mass flow balance through the dehumidifier.

20. An apparatus for determining a performance of a dehumidifier that includes a moisture removal device, the apparatus comprising a computer readable medium having stored instructions thereon that, when executed by a computing device, cause the computing device to perform a method to:

determine a first humidity value of airflow upstream from the moisture removal device;

measure an electrical current drawn by the dehumidifier;

using the measured electrical current, determine an efficiency of the dehumidifier determine a second humidity value of airflow downstream from the moisture removal device, wherein the second humidity value is based at least in part on the efficiency of the dehumidifier; and compare the first and second humidity ratios.

21. The apparatus of claim 20 wherein the computer-readable medium further includes instructions to:

receive a first value corresponding to a first temperature of airflow upstream from the moisture removal device;

receive a second value corresponding to a relative humidity of airflow upstream from the moisture removal device; and determine the first humidity value based at least in part on the first temperature and the relative humidity.

22. The apparatus of claim 21 wherein the computer-readable medium further includes instructions to receive a third value corresponding to the efficiency of the dehumidifier based on at least in part on a moisture removal rate of the dehumidifier.

23. The apparatus of claim 21, further comprising a housing at least partially surrounding the dehumidifier, wherein the computer readable medium is carried by the housing.

24. The apparatus of claim 23, further comprising:

a first sensing module carried by the housing proximate to an inlet through which airflow enters the dehumidifier, wherein the first sensing module detects the first temperature and the relative humidity of the airflow;

a second sensing module carried by the housing proximate to an outlet through which airflow exits the dehumidifier, wherein the second sensing module detects a second temperature of the airflow after the airflow passes the evaporator; and a processing module carried by the housing and configured to calculate the first humidity value, the second humidity value, and the difference between the first and second humidity values.

25. The apparatus of claim 20 wherein the apparatus is a portable apparatus that is movable relative to the dehumidifier.

26. The apparatus of claim 20, further comprising:

a sensing module configured to determine at least one of a first temperature and a first relative humidity of airflow upstream from the moisture removal device, and a second temperature of airflow downstream from the moisture removal device; and a processing module to determine the first relative humidity, the second relative humidity, and a difference between the first relative humidity and the second relative humidity.

27. A method of determining dehumidifier performance, the method comprising:

determining a first humidity value of airflow entering the dehumidifier;

measuring an electrical current drawn by the dehumidifier;

using the measured electrical current of the dehumidifier and an empirical performance factor, determining a second humidity value of airflow exiting the dehumidifier; and determining, with a processor, a difference between the first humidity value and the second humidity value.

* * * * *